US009626824B2

(12) United States Patent
Brosnan et al.

(10) Patent No.: US 9,626,824 B2
(45) Date of Patent: Apr. 18, 2017

(54) GAME RESULT GRAPHICAL VERIFICATION ON REMOTE CLIENTS

(75) Inventors: William R. Brosnan, Reno, NV (US); Jamal Benbrahim, Reno, NV (US); Steven G. LeMay, Reno, NV (US)

(73) Assignee: IGT, Las Vegas, NV (US)

( * ) Notice: Subject to any disclaimer, the term of this patent is extended or adjusted under 35 U.S.C. 154(b) by 1917 days.

(21) Appl. No.: 12/187,006

(22) Filed: Aug. 6, 2008

(65) Prior Publication Data

US 2009/0036190 A1 Feb. 5, 2009

Related U.S. Application Data

(63) Continuation-in-part of application No. 11/387,255, filed on Mar. 22, 2006, now Pat. No. 8,414,402,
(Continued)

(51) Int. Cl.
*A63F 9/24* (2006.01)
*G07F 17/32* (2006.01)

(52) U.S. Cl.
CPC ..... *G07F 17/32* (2013.01); *G07F 17/3234* (2013.01); *G07F 17/3225* (2013.01); *G07F 17/3227* (2013.01); *G07F 17/3241* (2013.01)

(58) Field of Classification Search
CPC .. G07F 17/32; G07F 17/3202; G07F 17/3225; G07F 17/3227; G07F 17/3241
(Continued)

(56) References Cited

U.S. PATENT DOCUMENTS 4,237,483 A 12/1980 Clever
4,283,709 A 8/1981 Lucero et al.
(Continued)

FOREIGN PATENT DOCUMENTS

AU 2003246322 4/2004
DE 19756693 6/1999
(Continued)

OTHER PUBLICATIONS

International Search Report and Written Opinion dated Jun. 30, 2005 from corresponding PCT Application No. PCT/US2005/001063, 13 pgs.
(Continued)

*Primary Examiner* — William H McCulloch, Jr.
*Assistant Examiner* — Chase Leichliter
(74) *Attorney, Agent, or Firm* — Neal, Gerber & Eisenberg LLP

(57) ABSTRACT

Methods an apparatus are described for verifying a game of chance is displayed correctly on a remote client. The verification may include storing game history information associated with a game of chance presented at a remote client. The server can provide a game outcome associated with the game of chance, and the game outcome can be presented visually on the remote client. A sample game outcome can be generated on a remote client and a user may be asked one or more questions about the sample game outcome to verify that the sample game outcome is correctly displayed on the remote client. In addition, the remote client can then generate a hash of the 1 game outcome and send the hash to the server. The server can store the client-generated hash and game history. If a dispute arises, this client-generated hash can be compared to a server-generated hash. A comparison of these hashes can be used to verify that the correct outcome was displayed on the remote client.

21 Claims, 8 Drawing Sheets

Related U.S. Application Data which is a continuation of application No. 10/758,828, filed on Jan. 15, 2004, now Pat. No. 7,384,339, which is a continuation-in-part of application No. 09/689,498, filed on Oct. 11, 2000, now Pat. No. 6,863,608.

(58) Field of Classification Search
USPC ..... 463/16, 20, 25, 39–43, 21, 24; 345/581, 345/618; 705/64, 65; 713/168; 709/229; 382/100
See application file for complete search history.

(56) References Cited

U.S. PATENT DOCUMENTS 4,448,419 A 5/1984 Telnaes
4,521,014 A 6/1985 Sitrick
4,607,844 A 8/1986 Fullerton
4,710,873 A 12/1987 Breslow et al.
4,782,468 A 11/1988 Jones et al.
4,948,138 A 8/1990 Pease et al.
5,127,651 A 7/1992 Okada
5,175,731 A 12/1992 Suarez
5,273,294 A 12/1993 Amanai
5,278,643 A 1/1994 Takemoto et al.
5,395,242 A 3/1995 Slye et al.
5,397,133 A 3/1995 Penzias
5,643,086 A 7/1997 Alcorn et al.
5,702,303 A 12/1997 Takemoto et al.
5,761,647 A 6/1998 Boushy
5,770,533 A 6/1998 Franchi
5,797,795 A 8/1998 Takemoto et al.
5,810,665 A 9/1998 Takemoto et al.
5,816,918 A 10/1998 Kelly et al.
5,816,922 A 10/1998 Nakajima
5,917,725 A 6/1999 Thacher et al.
5,947,821 A 9/1999 Stone
5,966,715 A 10/1999 Sweeney et al.
5,970,143 A * 10/1999 Schneier ..... A63F 13/71 380/251
5,971,851 A 10/1999 Pascal et al.
5,997,401 A 12/1999 Crawford
6,012,982 A 1/2000 Piechowiak et al.
6,018,720 A 1/2000 Fujimoto
6,021,196 A 2/2000 Sandford, II et al.
6,068,552 A 5/2000 Walker et al.
6,071,190 A 6/2000 Weiss et al.
6,089,975 A 7/2000 Dunn
6,104,815 A 8/2000 Alcorn et al.
6,106,396 A 8/2000 Alcorn et al.
6,110,043 A 8/2000 Olsen
6,115,532 A 9/2000 Saeki
6,117,013 A 9/2000 Eiba
6,120,379 A 9/2000 Tanaka et al.
6,131,192 A 10/2000 Henry
6,142,876 A 11/2000 Cumbers
6,149,522 A 11/2000 Alcorn et al.
6,167,562 A 12/2000 Kaneko
6,219,836 B1 4/2001 Wells et al.
6,224,485 B1 5/2001 Dickinson et al.
6,231,443 B1 5/2001 Asai et al.
6,234,900 B1 5/2001 Cumbers
6,270,412 B1 8/2001 Crawford et al.
6,302,793 B1 10/2001 Fertitta et al.
6,306,038 B1 10/2001 Graves et al.
6,319,125 B1 11/2001 Acres
6,322,451 B1 11/2001 Miura
6,336,865 B1 1/2002 Kinjo
6,350,199 B1 2/2002 Williams et al.
6,357,042 B2 3/2002 Srinivasan et al.
6,371,852 B1 4/2002 Acres
6,379,245 B2 4/2002 De Keller
6,404,418 B1 6/2002 Leem
6,409,602 B1 6/2002 Wiltshire et al.
6,421,738 B1 7/2002 Rattan et al.
6,425,825 B1 7/2002 Sitrick
6,435,969 B1 8/2002 Tanaka et al.
6,438,696 B1 8/2002 Barran et al.
6,446,119 B1 9/2002 Olah et al.
6,477,251 B1 11/2002 Szrek et al.
6,527,638 B1 * 3/2003 Walker et al. ..... 463/25
6,533,662 B2 3/2003 Soltys et al.
6,554,704 B2 4/2003 Nicastro et al.
6,577,733 B1 6/2003 Charrin
6,595,856 B1 * 7/2003 Ginsburg et al. ..... 463/29
6,626,761 B1 9/2003 Okada
6,641,484 B2 11/2003 Oles et al.
6,675,382 B1 1/2004 Foster
6,682,425 B2 1/2004 Nakayama
6,692,361 B1 2/2004 Itskov
6,780,106 B2 8/2004 DeMar et al.
6,863,608 B1 * 3/2005 LeMay et al. ..... 463/24
6,887,157 B2 5/2005 LeMay et al.
6,918,831 B2 7/2005 Nguyen et al.
6,926,605 B2 8/2005 Nguyen et al.
6,949,022 B1 * 9/2005 Showers ..... G07F 17/3241 273/292
7,076,495 B2 7/2006 Dutta et al.
7,384,339 B2 6/2008 LeMay et al.
7,563,166 B2 7/2009 Nguyen et al.
7,725,010 B2 5/2010 Seo et al.
7,841,940 B2 * 11/2010 Bronstein ..... G06Q 20/401 434/323
7,891,005 B1 * 2/2011 Baluja et al. ..... 726/26
1,087,252 A1 2/2014 Muzzy
2001/0044337 A1 11/2001 Rowe et al.
2002/0111207 A1 8/2002 Lind et al.
2002/0147047 A1 10/2002 Letovsky et al.
2002/0151363 A1 10/2002 Letovsky et al.
2002/0196342 A1 12/2002 Walker et al.
2003/0060286 A1 * 3/2003 Walker et al. ..... 463/42
2003/0069074 A1 * 4/2003 Jackson ..... G06F 8/20 463/43
2003/0195037 A1 10/2003 Vuong et al.
2003/0195043 A1 10/2003 Shinners et al.
2003/0228906 A1 12/2003 Walker et al.
2003/0228912 A1 * 12/2003 Wells ..... A63F 13/12 463/43
2004/0015554 A1 * 1/2004 Wilson ..... 709/206
2004/0053674 A1 * 3/2004 Nguyen ..... G07F 17/3202 463/20
2004/0053675 A1 * 3/2004 Nguyen ..... G07F 17/32 463/20
2004/0106449 A1 * 6/2004 Walker ..... G07F 17/32 463/25
2004/0147314 A1 7/2004 LeMay et al.
2005/0075154 A1 4/2005 Bordes et al.
2006/0035703 A1 2/2006 Nguyen et al.
2006/0035708 A1 2/2006 Nguyen et al.
2006/0178188 A1 8/2006 LeMay et al.
2006/0211490 A1 * 9/2006 Falvey et al. ..... 463/29
2007/0094717 A1 * 4/2007 Srinivasan et al. ..... 726/5
2007/0238524 A1 * 10/2007 Harris et al. ..... 463/42
2008/0076546 A1 3/2008 Moyle et al.
2008/0113791 A1 * 5/2008 Williams ..... G06F 21/31 463/29
2008/0113806 A1 * 5/2008 Alderucci ..... 463/42
2008/0119276 A1 * 5/2008 Alderucci ..... 463/42
2008/0214300 A1 * 9/2008 Williams ..... G06F 21/125 463/29
2009/0325661 A1 * 12/2009 Gross ..... A63F 13/12 463/9

FOREIGN PATENT DOCUMENTS

EP 1539312 6/2005
EP 1711923 10/2006
GB 2356483 5/2000
GB 2345862 7/2000
GB 2393027 3/2004

(56) References Cited

FOREIGN PATENT DOCUMENTS

| | | |
|---|---|---|
| RU | 2304011 | 8/2007 |
| WO | 01/41892 | 6/2001 |
| WO | 2005/071627 | 8/2005 |

OTHER PUBLICATIONS

US Notice of Allowance dated Mar. 14, 2005 from U.S. Appl. No. 10/243,464.
US Office Action dated Sep. 23, 2004 from U.S. Appl. No. 10/243,464.
US Advisory Action dated Jun. 29, 2004 from U.S. Appl. No. 10/243,464.
US Office Action dated Mar. 18, 2004 from U.S. Appl. No. 10/243,464.
US Office Action dated Nov. 6, 2003 from U.S. Appl. No. 10/243,464.
International Search Report dated Jan. 27, 2004 from Application No. PCT/US03/27130.
U.S. Office Action dated Oct. 21, 2009 from U.S. Appl. No. 11/181,662.
US Notice of Allowance dated Oct. 18, 2004 from U.S. Appl. No. 09/689,498.
US Advisory Action dated Apr. 19, 2004 from U.S. Appl. No. 09/689,498.
US Interview Summary dated Mar. 17, 2004 from U.S. Appl. No. 09/689,498.
US Office Action dated Jan. 13, 2004 from U.S. Appl. No. 09/689,498.
US Office Action dated Jun. 25, 2003 from U.S. Appl. No. 09/689,498.
US Office Action dated Jan. 15, 2003 from U.S. Appl. No. 09/689,498.
US Interview Summary dated Nov. 8, 2002 from U.S. Appl. No. 09/689,498.
US Office Action dated Aug. 23, 2002 from U.S. Appl. No. 09/689,498.
US Notice of Allowance dated Feb. 25, 2008 from U.S. Appl. No. 10/758,828
US Office Action dated Aug. 16, 2007 from U.S. Appl. No. 10/758,828.
US Office Action dated Jun. 1, 2007 from U.S. Appl. No. 10/758,828.
US Interview Summary dated Apr. 13, 2007 from U.S. Appl. No. 10/758,828.
US Office Action dated Dec. 19, 2006 from U.S. Appl. No. 10/758,828.
Third Party Submission dated Jul. 31, 2008 from U.S. Appl. No. 10/758,828.
EP Search Report dated Nov. 14, 2008 from EP Application No. 05705629.3.
U.S. Office Action dated Apr. 13, 2009 from U.S. Appl. No. 11/387,255.
Third Party Submission dated Jul. 31, 2008 from U.S. Appl. No. 11/387,255.
U.S. Office Action dated Dec. 17, 2009 from U.S. Appl. No. 11/387,255.
US Office Action dated Nov. 14, 2003 from U.S. Appl. No. 10/243,353.
US Office Action dated Apr. 21, 2004 from U.S. Appl. No. 10/243,353.
US Advisory Action dated Jul. 2, 2004 from U.S. Appl. No. 10/243,353.
US Office Action dated Sep. 23, 2004 from U.S. Appl. No. 10/243,353.
US Office Action dated Mar. 14, 2005 from U.S. Appl. No. 10/243,353.
Australia Examination Report dated Jan. 19, 2009 from Application No. 2003246322.
US Notice of Allowance dated Apr. 2, 2009 from U.S. Appl. No. 11/181,093.
US Advisory Action dated Feb. 20, 2009 from U.S. Appl. No. 11/181,093.
US Office Action dated Dec. 10, 2008 from U.S. Appl. No. 11/181,093.
US Office Action dated Apr. 30, 2008 from U.S. Appl. No. 11/181,093.
Search Report dated Jan. 12, 2004 from Application No. GB0321515.9.
Russian Office Action dated Oct. 16, 2006 from Russian Application No. RU2005110937.
US Office Action dated Jul. 12, 2010, from U.S. Appl. No. 11/515,329.
US Office Action dated Dec. 16, 2010, from U.S. Appl. No. 11/515,329.
US Office Action dated May 5, 2011, from U.S. Appl. No. 11/515,329.
US Office Action dated Oct. 21, 2011, from U.S. Appl. No. 11/515,329.
U S Final Office Action dated Jun. 16, 2010 from U.S. Appl. No. 11/181,662.
International Preliminary Report on Patentability dated Jul. 17, 2006 from Application No. PCT/US2005/001063.

* cited by examiner

GAME RESULT GRAPHICAL VERIFICATION ON REMOTE CLIENTS

CROSS-REFERENCE TO RELATED APPLICATIONS

The present application is a continuation-in-part of U.S. patent Ser. No. 11/387,255, filed Mar. 22, 2006, "FRAME BUFFER CAPTURE OF ACTUAL GAME PLAY," which is a continuation of U.S. patent application Ser. No. 10/758,828, entitled "FRAME CAPTURE OF ACTUAL GAME PLAY," by LeMay et al., and filed on Jan. 15, 2004, now U.S. Pat. No. 7,384,339, which is a continuation-in-part of U.S. patent application Ser. No. 09/689,498, filed on Oct. 11, 2000, now U.S. Pat. No. 6,863,608, both of which are incorporated by reference in their entirety for all purposes.

BACKGROUND OF THE INVENTION

I. Field of the Invention

The present invention relates to methods and apparatus for preserving and verifying game history on wagering-type gaming machines. More particularly, the present invention relates to storing game history information and verifying game outcomes graphically presented on remote gaming machines.

II. Background

Gaming machines such as mechanical reel slot machines, video slot machines, video poker machines, and the like, have typically been located on the property of gaming establishments such as casinos, etc. By locating these gaming machines on the premises and continuing to monitor and control these machines, gaming establishments can effectively maintain game histories for games played on these games and resolve disputes regarding gaming outcomes by investigating the gaming machines on the premises.

An important feature of these on-site gaming machines is the ability to store and re-display historical game play information. The game history information assists in settling disputes concerning the results of game play. A dispute may occur, for instance, when a player believes an award for a game outcome was not properly credited to him by the gaming machine. The dispute may arise for a number of reasons including a malfunction of the gaming machine, a power outage causing the gaming machine to reinitialize itself and a misinterpretation of the game outcome by the player. In the case of a dispute, an attendant typically arrives at the gaming machine and places the gaming machine in a game history mode. In the game history mode, important game history information about the game in dispute can be retrieved from a non-volatile storage on the gaming machine and displayed in some manner to a display on the gaming machine. The game history information is used to reconcile the dispute.

On video gaming machines such as video poker games or video slot games, the machines are typically operable to provide a visual display of the game history. It is possible to provide a text only version of a game outcome that has been displayed on the gaming machine. However, the visual display of the game history is usually more convincing to a player. Further, it can help the game player disputing the results on the gaming machine to recall the actual results. Both of these factors can lead to a faster and more satisfying resolution of the dispute.

Usually, only a subset of the game history is played back instead of the entire game. For example, for a video poker game, the visual display of information might include a graphical presentation of the initial cards dealt to the player, a graphical presentation of the cards drawn and a graphical presentation of the final hand. After the attendant and player visually review these results, the dispute may be settled.

The recall of the graphical presentation for game history playback has traditionally been achieved by retrieving critical game data from the non-volatile memory on the gaming machine and recreating an approximation of the graphical game presentation using a subset of the game code. The subset of the game code is derived from the game code used to generate the actual game of chance. For each game played on the gaming machine, critical game data stored in non-volatile storage may include the number of credits on the gaming machine when the game was initiated, the wager amount on the game, the paytable used to calculate the game outcome, the game outcome, image positioning information and any other information needed to recreate the visual game history. Often because of storage limitations of the non-volatile memory, a graphical presentation corresponding to the actual game play cannot be identically recreated and only a few specially selected visual portions of the game presentation are regenerated.

Although gaming machines have typically been located on the property of gaming establishments such as casinos, etc., gaming on network gaming environments such as the Internet has also seen a dramatic increase in recent years. This includes gaming in which wagering on the outcomes of games of chance is facilitated. The need for outcome verification and validation in this setting is at least as great as for conventional gaming environments.

In view of the above, it would be desirable to provide method and apparatus that allow outcome verification and validation in an network gaming environment, such as the Internet.

SUMMARY OF THE INVENTION

The techniques of the present invention address the above need by providing methods, code and apparatus for verifying that a game of chance is correctly presented on a remote client. According to various embodiments, information associated with the verification may be stored as game history information maintained at a gaming establishment providing the game of chance. When a game outcome is presented at the remote client, the remote client may generate a hash of the visual component of the game outcome and then send this hash to the gaming establishment. In the event of a dispute, the gaming establishment can compare the client-generated hash to a hash produced at the gaming establishment from the stored game history. With the results of this comparison, a gaming establishment can confirm that a visual presentation of the game outcome was generated correctly when the hashes match and pursue further investigation if the hashes do not match. In another embodiment, a sample game outcome may be generated on a remote client and a user may be asked one or more questions about the sample game outcome to verify that the sample game outcome is correctly displayed on the remote client. In this manner, gaming establishments can offer games to remote clients and verify the outcomes of these games if a dispute occurs, even when the remote client is outside the immediate control of the gaming establishment.

One aspect provides a method for of generating a game of chance on an apparatus. The method may be generally characterized as comprising: 1) receiving from a remote client a selection of the game of chance to be generated on the remote client; 2) generating instructions for a test image including a representative outcome of the selected game of chance for output on a display associated with the remote client; 3) generating one or more questions relating to information in the test image wherein the one or more questions are for output on the display associated with the remote client; 4) receiving information generated in response to the one or more questions from the remote client wherein said information is associated with one or more activations of an input device at the remote client; 5) determining whether to allow game play to proceed on the remote client based upon the information generated in response to the one or more questions associated with the test image; 6) storing information associated with the test image, the one or more questions and the information received in response to the one or more questions; 7) receiving a wager on a game outcome of the selected game of chance; and 8) providing the game outcome associated with the selected game of chance, wherein the game outcome is presented visually on the remote client.

The remote client may be a mobile gaming device. The server and remote client may communicate through the Internet. In addition, the server and remote client communications may utilize a wireless communication connection.

The method may further comprise generating 1) a plurality of test images, 2) receiving a selection of a new game of chance for play on the remote client, generating instructions for a new test image including a representative outcome for the new game of chance; and generating one or more questions relating to information displayed in the new test image for output on the display associated with the remote client, 3) receiving a hash of the test image from the remote client; generating on the apparatus the test image; hashing the test image generated on the server; and determining if the client-produced hash of the test image matches a server-produced hash of the test screen or 4) combinations thereof. The hash may be taken of a portion of the test image where the portion includes an outline of shapes, a color, a region, or a payline.

In yet other embodiments, the method may further comprise, performing periodic diagnostics on the remote client. The performing of the periodic diagnostics on the remote client may include, sending the test image to the remote client; receiving a hash of the test image from the remote client; and determining if the client-produced hash of the test screen matches a server-produced hash of the test image. The method may also comprise receiving a request from the remote client to resolve a dispute regarding the game outcome; receiving a first image generated on the remote client; generating a second image at the server using stored game history information associated with the first image; comparing the first image to the second image to determine whether information displayed in the first image matches information displayed in the second image.

Additionally, the method may further comprise 1) receiving a request from the remote client to resolve a dispute regarding the game outcome; receiving a first hash of a first image generated on the remote client; generating a second image at the server using stored game history information associated with the first image; generating a second hash of the second image; comparing the first hash to the second hash to determine whether information displayed in the first image matches information displayed in the second image, 2) establishing communications between the server and remote client; determining the type of hardware used by the remote client; and determining if the hardware is compatible with the game of chance, 3) determining if the hardware is compatible with the game of chance includes determining the screen resolution of the remote client, 4) receiving a file of a test image displayed at the remote client; and storing the file at the server or 5) combinations thereof.

Another aspect may be generally characterized as a gaming system comprising: I) a server operable to generate a game outcome for a game of chance, said server designed or configured to 1) receive from a remote client a selection of the game of chance to be generated on the remote client; 2) generate instructions for a test image including a representative outcome of the selected game of chance for output on a display associated with the remote client; 3) generate one or more questions relating to information in the test image wherein the one or more questions are for output on the display associated with the remote client; 4) receive information generated in response to the one or more questions from the remote client wherein said information is associated with one or more activations of an input device at the remote client; 5) determine whether to allow game play to proceed on the remote client based upon the information generated in response to the one or more questions associated with the test image; 5) store information associated with the test image, the one or more questions and the information received in response to the one or more questions; 6) receive a wager on the game outcome of the selected game of chance; and 7) provide the game outcome associated with the selected game of chance, wherein the game outcome is presented on the display of the remote client; II) the remote client configured to communicate with the server, said remote client comprising the display and input device; and III) a network configured to allow communication between the server and the remote client. The remote client may be a mobile gaming device. Further, the network may include one or more wireless links.

Yet another aspect of the invention pertains to computer program products including machine-readable media on which are stored program instructions for implementing a portion of or an entire method as described above. Any of the methods of this invention may be represented, in whole or in part, as program instructions that can be provided on such computer readable media. In addition, the invention pertains to various combinations of data generated and/or used as described herein.

These and other features and advantages of the present invention will be described in more detail below with reference to the associated figures.

DETAILED DESCRIPTION OF INVENTION

Figure 1:
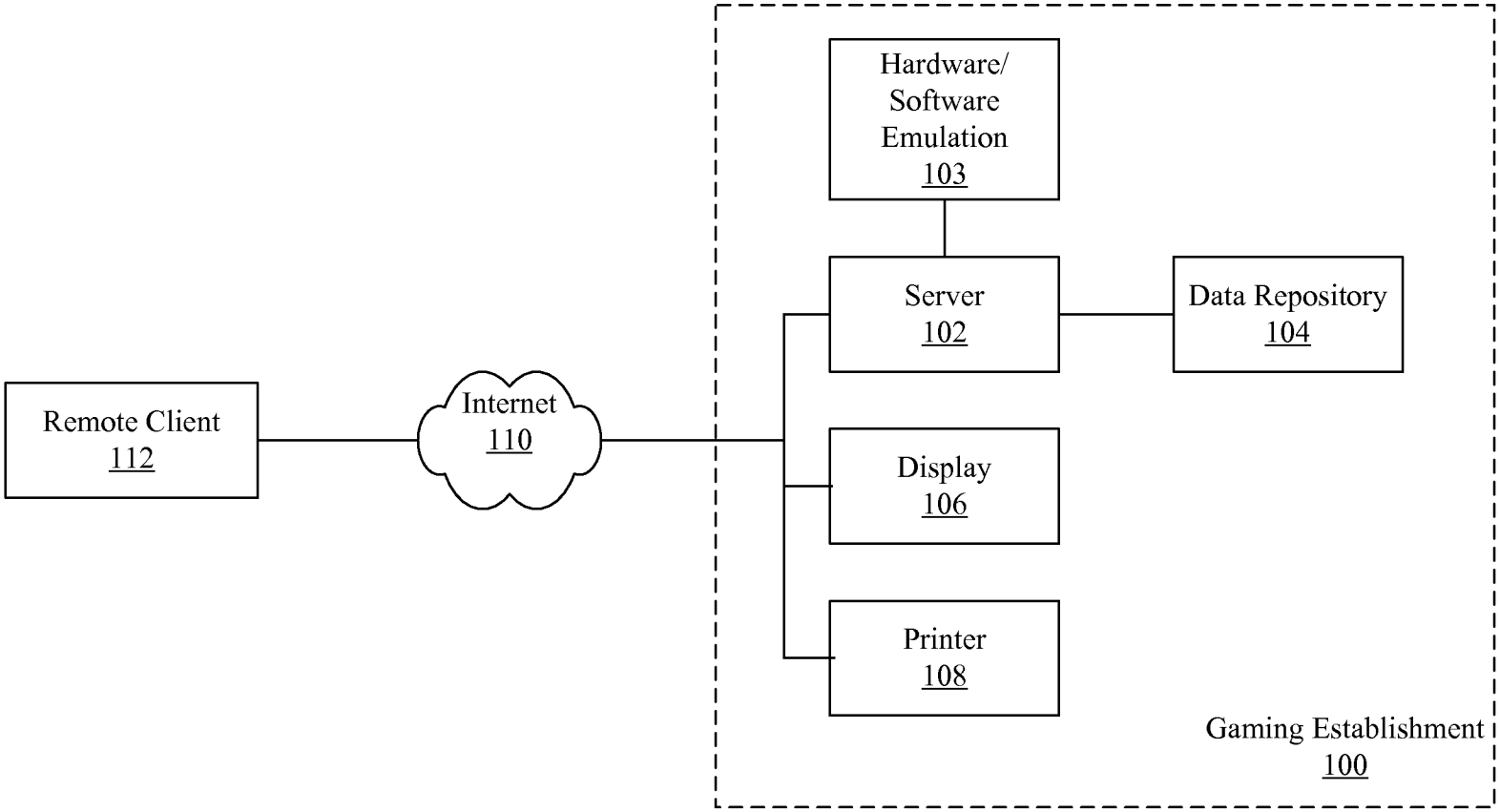
FIG. 1 is a simplified block diagram of a network environment in which specific embodiments may be implemented.

As described above in the Background section, remote gaming, such as Internet or other network-based gaming, is rapidly gaining popularity. However, there is currently no consistent way of verifying the results of a remote game that are visually presented on a remote client. Even if the game history and game results are stored at a server providing the remote game to the remote client and the remote client itself where the remote game is presented to a player, it is difficult for gaming operators to verify the results actually presented to the player. A lack of visual verification capability is a disadvantage in resolving disputes.

For instance, players may be tempted to claim false winnings and provide evidence of these false winnings using modified visual records. In particular, players can use photo editing software, and the like, to modify at least a portion of the visual game outcome, such as the number of credits awarded, the number of credits bet, the paylines selected, etc. Furthermore, players can also modify game history information stored on the remote machine to be consistent with the visual records. Consequently, gaming establishments presenting these games of chance on remote machines need a way to verify that the accuracy of results presented on a remote client. Otherwise, gaming establishments can lose time and money when presented with fraudulent claims of winnings.

Another difficulty in providing visual verification on a remote client is that the remote may vary in processing power and graphics capabilities. For example, the graphical processing capabilities and screen resolution between a home computer, a personal digital assistant, tablet PC, and a cell phone vary significantly. Yet, each of these devices may be used as a remote client to play games.

Further, even within a particular device category, such as a home computer or a cell phone, the devices within the category may vary significantly. For example, a first home computer may employ a first monitor of a first size, set to a first resolution, set to a first aspect ration and include a separate graphics card while a second home computer may use a second monitor of a second size, set to a second resolution, set to a second aspect ration and may have graphics capabilities built into the motherboard that eliminates the need for a separate graphics card. These hardware differences can affect what is stored to a frame buffer prior to display on a monitor and hence visual verification of any images displayed to the monitor.

Accordingly, various embodiments of the present invention provide a system for storing game history information for a game of chance presented on a remote client and methods for verifying that these results have been displayed correctly. In particular, a gaming establishment, such as a brick and mortar casino, or an Internet based gaming establishment, or the like, can present games of chance that are displayed on remote clients and store game history information for these games at the gaming establishment. The game history information may include information regarding what was actually displayed on the remote client, such as a hash of an image stored in a frame buffer of the remote client.

According to various embodiments, prior to allowing a game of chance to be played on a remote client, a server and the remote client may go through an initiation process where the hardware/software display capabilities of the remote client are determined and visual images generated by the remote client are verified. After this initialization process, when a game outcome is presented at a remote client, the remote client can provide a hash of the game outcome including information regarding the visual display of the game outcome at the remote client and this hash can be stored at the gaming establishment. Further, in a particular embodiment, the remote client may be operable to send a screen capture of an image displayed on the remote client to a device at the gaming establishment. If a dispute about the game outcome later arises, the gaming establishment can use the game history information to regenerate the game outcome and independently provide a hash of this regenerated game outcome as well as in some instances recall an actual screen shot. If the client-generated and gaming establishment-generated hashes match, then the game outcome can be confirmed and no dispute exists. Otherwise, if the hashes fail to match, additional investigation into the discrepancy can be pursued.

By comparing the client-generated and gaming establishment-generated hashes, gaming establishments can more efficiently verify game outcomes for gaming devices operated in a remote gaming environment. These hashes can be transmitted and stored at the gaming establishment without requiring large amounts of bandwidth or storage space. Furthermore, disputes can typically be resolved at the gaming establishment, without the need to inspect the remote machine. Accordingly, gaming establishments may be able to resolve disputes more quickly for games of chance presented in a remote gaming environment.

Turning to FIG. 1, shown is a simplified block diagram of a network environment in which a specific embodiment of the present invention may be implemented. In particular, gaming establishment 100 can provide games of chance, such as video slot games, video poker games, video keno games, video card game, video lottery, video bingo games and the like, to remote client 112. Although only one remote client 112 is shown, gaming establishment 100 can provide games of chance to any number of remote clients. In particular embodiments, the remote client 112 may be one of a cell phone, a home computer, a PC tablet, a laptop a player tracking unit, a casino-type gaming machine, a home entertainment device, such as a Microsoft Xbox 360™, any other type of portable or non-portable device capable of remote communication with the server 102 and operable to display a game of chance.

In one embodiment, gaming establishment 100 includes server 102, data repository 104, display 106, and printer 108. Server 102 can present games of chance to remote client 112 through an Internet connection 110, network connection or other network infrastructure. Game history information for such games of chance can be stored in data repository 104 or some other storage device coupled to the server 102. In some embodiments, data repository 104 can be integrated with server 102. Display 106 can be used to show a game outcome generated from game history information, especially when a game outcome is disputed. In particular embodiments, a secondary game, such as a bonus game, may be associated with or triggered from a primary game. Thus, the "game history" may be stored for the bonus game on the remote client 112, the server 102 or combinations thereof.

In general, information pertaining to any image or sequence of related images displayed on the remote client 112 may be stored as an "image history." For example, a player may use the remote client 112 to play games by a pool associated with the gaming establishment 100. The remote client 112 may be operable to allow the player to order food and drinks, make reservations, purchase goods, and obtain other casino services. An image history, such as a record of a food/drink order or a dinner reservation, may be stored for each of the services ordered using the remote client 112. This image history, may comprise but is not limited to a textual description of the information displayed in the image, information that allows one or more images in a sequence of images associated with the image history to be re-rendered, a stored version of the previously rendered and displayed image and combinations thereof. The image history may be used to resolve disputes. For instance, the image history could be used to resolve a dispute regarding a purchase made using the remote client 112.

Other types of information that may be stored with an image history may include but is not limited to 1) information describing the remote client, such as hardware identifiers and software identifiers, 2) date and time stamps and 3) information input at the remote client, such as a game choices or biometric information input at the remote client. For example, a player may have a finger print read prior to or during play of games or the player may have a picture taken prior to or during play of games on the remote client. This information may be included in the image history information. In another embodiment, links to information may be included in the image history information. For example, if a player were playing a mobile gaming device by a pool and the pool included surveillance cameras, then the image history information could include links to images files taken by the surveillance cameras in the event of a dispute.

Returning to FIG. 1, the server 102 may generate an image history for a game played on the remote client 112, i.e., a game history. One aspect of the present invention is to verify that images generated on the remote client 112 are accurate representations of an intended game outcome. The intended outcomes may be displayed on remote clients using various graphical rendering and display capabilities.

To allow the accuracy of images displayed on remote client to be verified, the server 102 may perform a number of operations prior to the beginning of game play on the remote client. In one embodiment, prior to the beginning of game play on the remote client, the server 102 may attempt to simulate an image generated on the remote client based on the remote clients software and hardware configuration and compare it with the results of an actual image generated on the remote client 112. For instance, after determining the remote clients hardware and software settings, the server 102 may request the remote client to generate a test image and send a copy of the test image and/or a hash value of the test image to the server. The server 102 may then generated a simulated image of what it believes the remote client 112 is supposed to generate as well as a hash value for the simulated image.

After receiving test image from the remote client and generating the simulate image, the server may directly compare the two images. For instance, if the test image and the simulated image are in a color or monochrome bit map format, then the server may compare bit values for matching pixels in the images. If the all pixel data match or a percentage of the pixel data matches above, a specified threshold percentage, or a hash value generated from the test image and the simulated image match, then the server may conclude that it can reproduce the image data generated on the remote client. The image reproduction capability of the server may be used to verify that the remote client is faithfully reproducing game outcomes.

In another embodiment, the server 102 may be operable to generate a test image and send it to the client 112 or generate instructions that allow the test image to be generated on the remote client. After the test image is displayed on the remote client the server may prompt the player to answer one or more questions about the test image that allow the server 102 to determine various aspects of the test image are visible to the player.

Figure 1A:
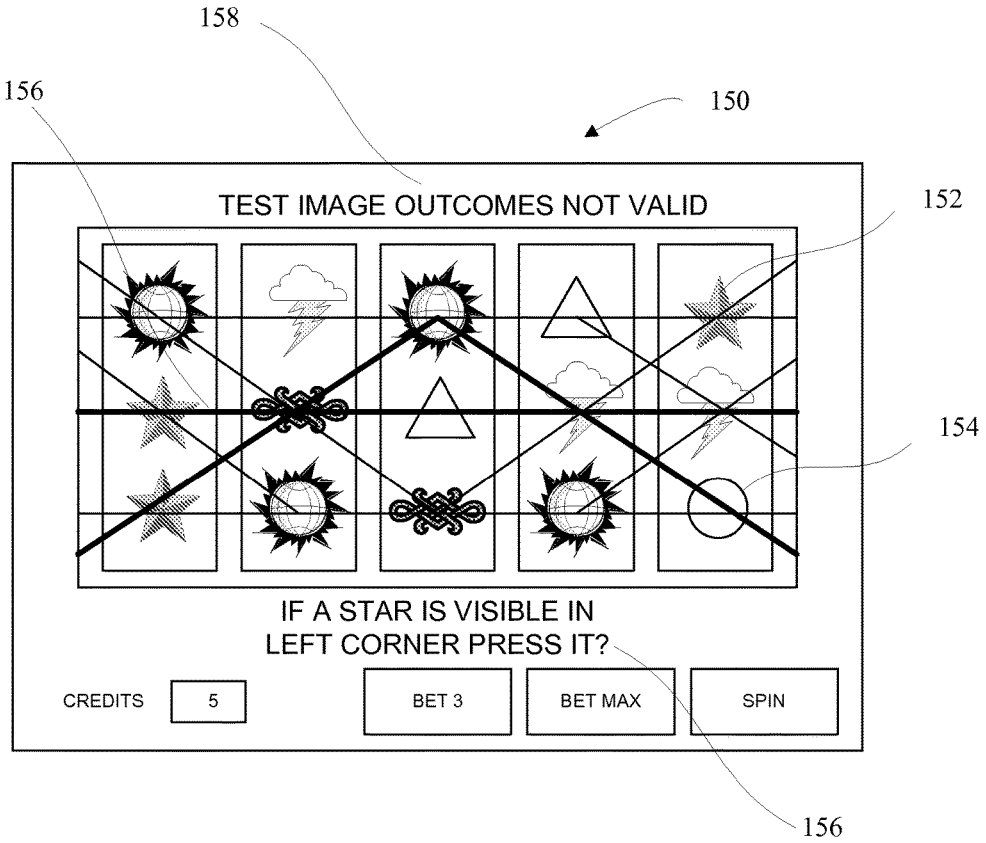
FIG. 1A is an example of a test image for a specific embodiment.

For example, a test image 150 is shown with respect to FIG. 1A that may be generated on the remote client. In one embodiment, the test image may be a sample outcome for a game selected by the player for play, which may be randomly generated. The sample outcome may be representative of outcomes that may be generated when the selected game is played. The sample image may include a message, such as 158, to indicate that the image is a test image and is not a valid outcome. In one embodiment, the representative outcome that is selected by the server 102 may be only an outcome that doesn't indicate an award. Only a non-award outcome may be associated with the test image 152 to prevent a situation where the test image indicates a big award, which may be potentially upset the player if they don't realize it is only a test image.

After the image 150 is generated on a display associated with client 112, one or more questions may be asked about the test image, such as question 156, may be displayed on the test image and the player may be prompted for a response. For instance, if the display associated with the device is a touch screen the player may be asked a question 156, such as "if a star 152 is visible in the left corner press it." In another example, the player may be asked to press the bet max button if 5 credits are visible on the credit meter. As another example, the player may be asked the question if the center payline 156, the star 152 and the circle 154 are clearly visible please provide an indication by activating a feature of an input device. The star 152 may flash or may be highlighted in some manner to quickly the player's attention to it on the test image.

The input device could be a key board, button panel, touch screen, mouse or other input device associated with the remote client 112 and the feature to be activated refers to an appropriate input associated with the input device. For instance, for a mouse, the activated feature may be clicking on a particular location on the test image. For a keyboard, the activated feature may be type the word "star" if the star 152 is visible.

The questions may differ each time a test image is generated because the test image may be a randomly generated outcome. In one embodiment, multiple test images may be utilized where questions may be asked about each image. In one embodiment, each time a player selects a different game to play, a new test image may be generated and the player may be prompted to answer questions about the test image 152. In another embodiment, the test image 152 and associated questions may be generated only at the beginning of a game play session. In yet another embodiment, game play may not be allowed to proceed until one or more questions are correctly answered about a test image.

In yet other embodiments, the questions about a test image may be selected such that a confirmation of the visibility of information in various regions of the test image are obtained. For example, the test image may be divided into a number of portions, such as 4, 8, 10, etc, and questions pertaining to the visibility of information in each of the portions or less than all of the portions may be generated. The test image or images, the asked questions and the received responses may be saved as a game history record associated with the game playing session associated with the remote client 112. The game history record may be retrievable in the event of a dispute.

Returning to FIG. 1, when a game outcome is disputed by a player at remote client 112, the game outcome can be regenerated at gaming establishment 100 and displayed at display 106 and/or remote client 112. In some cases, a game operator can then arbitrate the dispute based on the game outcome displayed. In addition, printer 108 can be used to print out regenerated game outcomes in the event of a dispute.

In one embodiment, the remote client 112 may store a record of a game history separate from the game history stored at the server 102. In other embodiments, the remote client may not be operable to store any game history information. When the remote client 112 is operable to store game history information, the remote client may store game history information for a number of games previously played on the remote client. The game history information may comprise but is not limited to a) basic descriptive information in textual format, such as an amount of credits, whether the game was provide an award or not, b) information that allows an image of the game outcome for a previously played game to be re-rendered and displayed on the remote client (this information could include inputs needed for a particular graphical engine used on the remote client 112), c) a stored version of a previously rendered image, d) inputs received from the remote client during game play, such as game decisions, wager amounts, etc, and e) combinations thereof.

The game history information stored on the remote client 112 and/or the server 102 may be directly accessible to the player. In one embodiment, when the player has access to the game history information, the player may be able to access, via an interface on the remote client 112, information regarding previously played games. The game history information accessed via the interface may be stored on the remote client 112 or at the server 102. For example, the player may be able to sequentially browse through their game history or select the game history for a particular game to view. This feature may allow the player to resolve a discrepancy prior to contacting a remote operator.

In a particular embodiment, when game history information is stored on the remote client 112 and the server 102, an interface may be provided on the remote client that allows the player to compare game history information for a particular game stored on each of the devices. For instance, the remote client may be operable to display a first stored image from a game outcome previously played and stored on the remote client and a second image from the game outcome previously played on the remote client that was rendered using game history information stored on the server. If the display is large enough on the remote client, the player may be able to look at game history information from both sources in a side-by-side manner, such viewing the first image and the second image in a side by side manner. If the display is too small, then the information could be viewed sequentially, such as by displaying the first image and then followed by the second image in the example described above.

The game history information accessible to the player may be a sub-set of the information that is accessible to an operator. For instance, the player may be able to view images of previously played games but may not be able to access the raw data used to generate the images. This raw data used to generate the images, which may be stored as game history information, may be accessible only to an operator of the server 102.

In other embodiments of the present invention, game history information may be only provided to the player on the remote client in conjunction with a remote of operator of the server 102. For example, in the event of a dispute, the player may contact an operator at gaming establishment 100 in some manner, e.g., e-mail, text message, phone call, etc. At the player's request, the operator may access the game history information and provide it to the player in some manner.

In particular embodiments, the operator may be to control/command the remote client to access functions on the remote client that are only available to the operator. These control/command functions may allow the operator to perform diagnostics on the remote client to determine if it is operating correctly and to display game history information that is stored on the remote client and/or the server 102. In other embodiments, for instance, when the remote client is malfunctioning, the operator may be able to transmit game history information to the player via other communication channels. For example, the operator could mail, fax or e-mail game history information to an address the player has identified or just orally communicate the game history information to the player.

Returning to the embodiment of FIG. 1, gaming establishment 100 can be a casino, a central location for wide area progressive games, and the like. As noted above, the remote client 112 can be a device that is outside the control of gaming establishment 100. For instance, remote client 112 can be a personal computer, handheld device, cell phone, set top box, wireless device, or the like, that is not typically located on the game establishment's property. In contrast to gaming machines located in a casino or hotel room associated with the gaming establishment 100, remote client 112 is not monitored or secured by the gaming establishment 100. Instead, the remote client can be located at a player's home, at a private business, or the like. Even if remote client 112 is physically located on the property of the gaming establishment 100, the remote client 112 may not be closely monitored by gaming establishment 100 as a gaming device located on a casino floor.

In the present embodiment, the gaming establishment 100 communicates with remote client 112 through a network such as the Internet, or the like. The network may include wireless or wired links and access points. Although a particular network configuration is shown, it should be recognized that various configurations of devices can be included within the scope of the present invention. In particular, various devices can be added, omitted or combined according to various embodiments. For instance, printer 108 can be omitted in some embodiments, and additional servers can be added in other embodiments. Further, as noted above, the data repository 104 and the server 102 functions may be combined into a single device.

Figure 2:
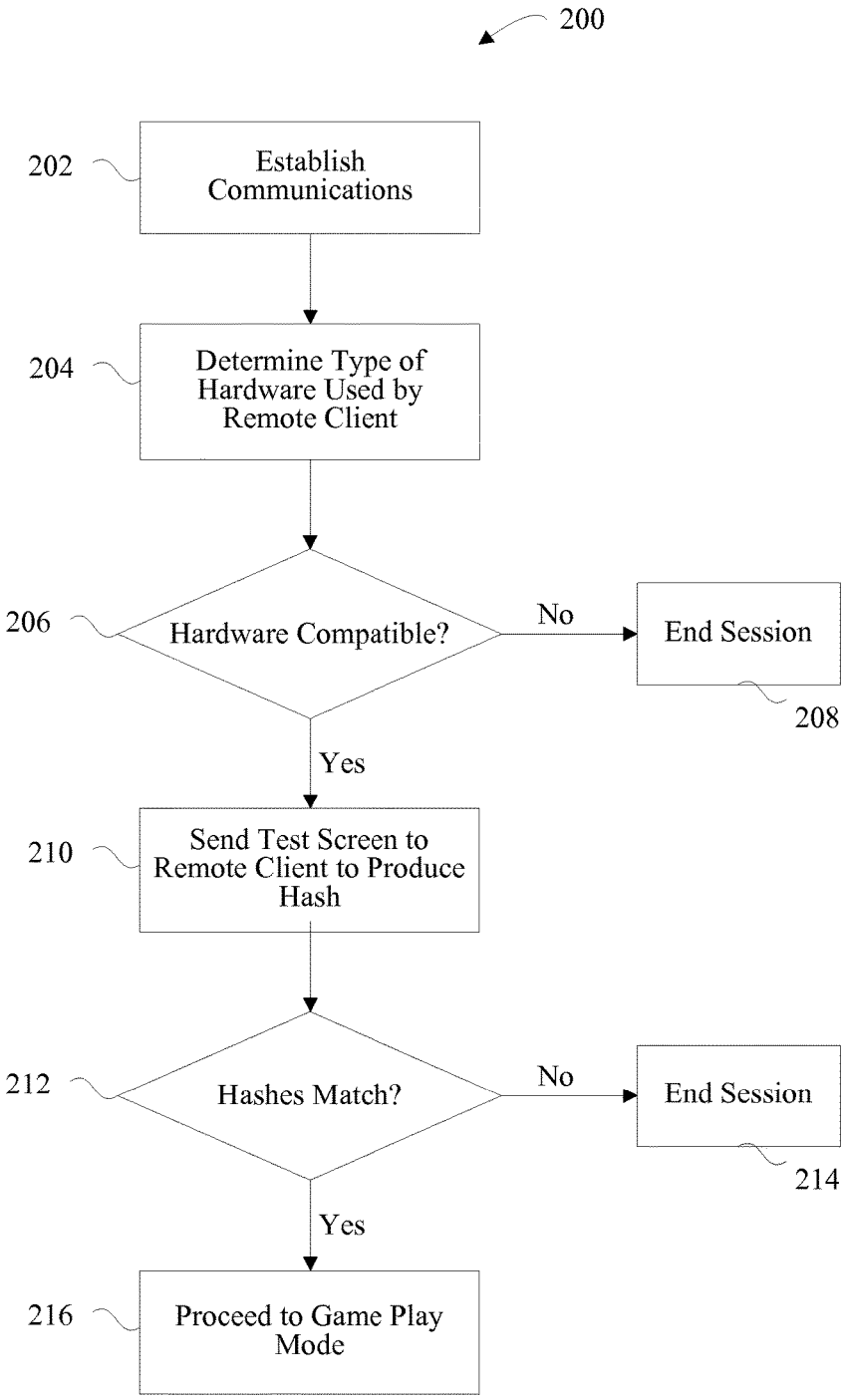
FIG. 2 is a flow chart depicting a method for initiating game play on a remote client according to one embodiment.

With reference to FIG. 2, shown is a flow chart depicting a method for initiating game play on a remote client according to one embodiment. The initiation sequence 200 begins at 202 where prior to presenting a game of chance to a remote client 112, the server 102 and remote client 112 establish communications with each other. Next, at 204, the type of hardware used by the remote client can be determined. More particularly, information such as the type of CPU, system, features, capabilities, and the like, can be determined. In addition, the type and version of game software used by the remote client 112 can be determined. In some embodiments, remote client 112 can be required to use a video card that can make floating point calculations, etc. At 206, it is determined whether the remote client's 112 hardware and/or software is compatible with server 102, gaming establishment 100, and/or the games of chance provided by these entities. If the remote client's 112 hardware is not compatible, then the gaming session can be terminated. See 208. In some embodiments, a message can be provided to the remote client 112 that specifies the type of hardware and/or software needed to play games of chance presented by gaming establishment 100.

If the remote client's 112 hardware is compatible, then server 112 can send a test screen to the remote client. See 210. The test screen can include text, graphics, colors, or the like, and can be used to determine whether the remote client 112 can detect the items included in the test screen. The remote client 112 produces a hash of the test screen and sends the hash to server 102. The hash can be made of actual screen data, buffered screen data, or the like. Furthermore, the hash can be in any convenient format such as an MD5 hash, or the like. The MD5 hash can produce a digest of about 16 bytes. Additionally, the hash can be of whole or selected portions of the test screen. In particular, FIGS. 6A-6C include examples of regions of a game presentation screen that can be hashed according to various embodiments of the present invention.

Figure 6A:
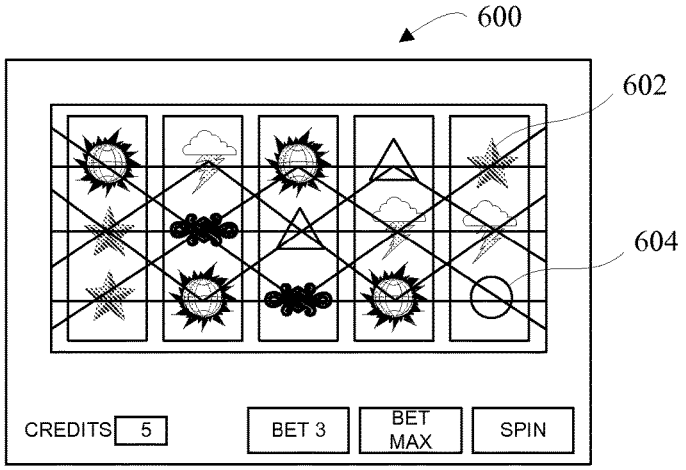
FIGS. 6A-6C is a diagrammatic representation of portions of a visual game outcome that can be hashed according to various embodiments.

With reference to FIG. 6A, game presentation screen 600 includes graphics with various colors 602 and outlines of shapes 604. A hash can be taken of the entire presentation screen 600, of selected colors (e.g. blue, red, black, etc.), outlines, or the like. Furthermore, and some embodiments, this presentation screen 600 can be color reduced and a hash can be taken of the color reduced image. For instance, the game presentation screen 600 can be reduced to black and white and this black and white screen can be hashed. In other embodiments, a selected payline or paylines may be hashed.

Figure 6B:
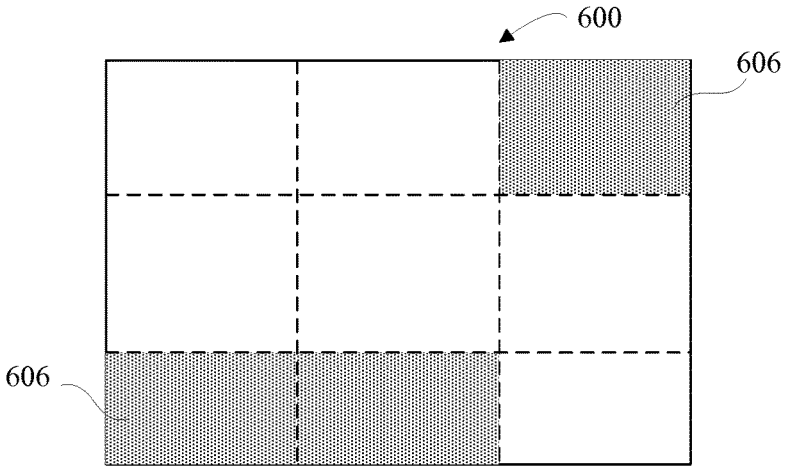

With reference to FIG. 6B, another example of a game presentation screen 600 is shown. In this embodiment, selected regions 606 are chosen for hashing. These regions can be chosen based on the importance of the information included within the regions. For instance, a region of the game presentation screen 600 containing the number of credits awarded can be hashed. Similarly, a region of the game presentation screen 600 containing a payline can be hashed. Other regions can also be selected depending on application.

Figure 6C:
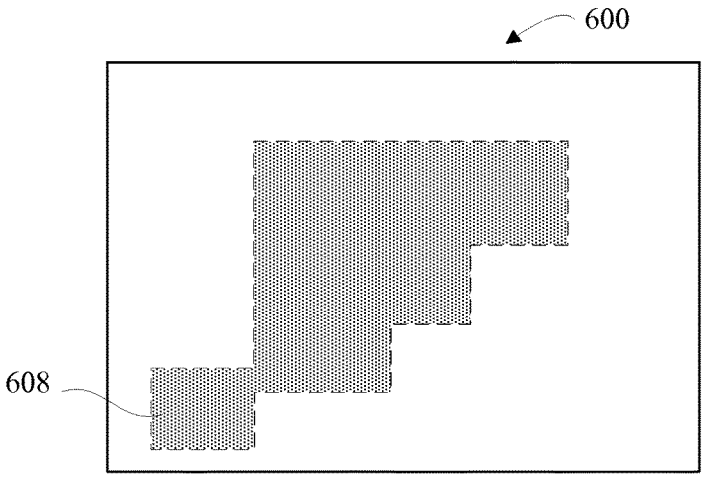

With reference to FIG. 6C, shown is yet another example of the game presentation screen 600. In this embodiment, a customized region 608 can be hashed. This customized region 608 can be irregular in shape, and can be predetermined based on the location of critical game history information. For instance, if the game presentation screen 600 displays a game outcome, and the game outcome screen includes a particular configuration of critical information such as whether a player has won or lost, the amount of any winnings, etc., this particular configuration can be designated as the customized region 608, and this region can be hashed.

FIGS. 6A-6C depict exemplary embodiments of game presentation screens 600. Hashes of the game presentation screens 600 or portions of the game presentation screens 600 can be used to verify game outcomes when the processing speed of the remote client 112 and server 102 dictates that hashing and storing hashes of such game presentation screens 600 would be more efficient than sending and storing the entire game presentation screens 600 or a portion of the actual game presentation screens. In some embodiments, where bandwidth allows, portions of the game presentation screens 600 can also be sent to the server 102 along with the client-generated hash. And in yet other embodiments, where bandwidth is even more plentiful, game presentation screens 600 can be sent in their entirety with the client generated hash, without simplification of the images, etc. on the game presentation screens 600.

Returning to the embodiment of FIG. 2, once the remote client 112 sends the hash to the server 102, the client-generated hash can be compared to a hash of the same test screen generated by the server 102. See 212. The server 102 can either pregenerate the hash and store this hash for comparison, or can generate the hash during the initiation process. If the hashes fail to match, then the gaming session can be terminated at 214. In some embodiments, a message can be provided to the remote client 112 that specifies the type of error encountered. For instance, if the remote client 212 did not hash a particular game presentation screen correctly, a message can be displayed indicating that the remote client's video card may need replacing. If the hashes match, then the remote client can be permitted to proceed to game play at 216.

Although the present embodiment describes particular procedures associated with initiating communication between a server 102 and remote client 112, it should be recognized that various processes can be added or omitted according to various embodiments. For instance, the remote client's 112 memory card can also be tested in some embodiments.

Figure 3:
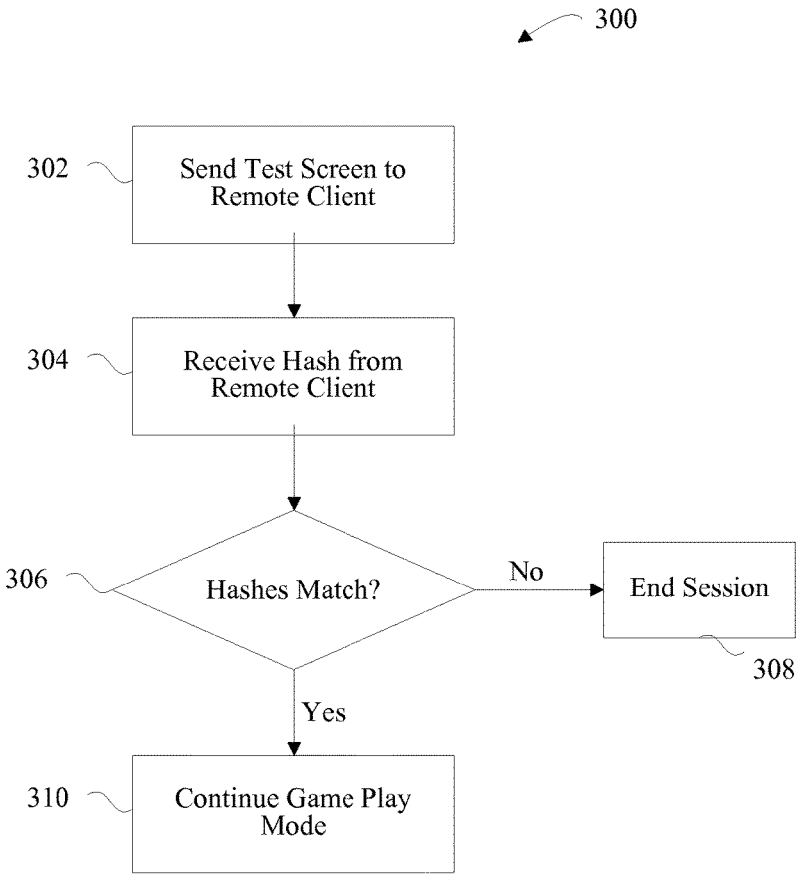
FIG. 3 is a flow chart depicting a method for performing diagnostics on a remote client according to one embodiment.

With reference to FIG. 3, shown is a flow chart depicting a method for performing diagnostics on a remote client according to one embodiment. These diagnostics can be performed periodically to detect whether hardware or other features are performing properly. For instance, after every fifth game, the diagnostics can be performed to determine if the hardware or memory has begun to fail in some manner.

In the present embodiment, the diagnostic sequence begins at 302 with server 102 sending a test screen to the remote client 112. See 302. The test screen sent can be similar or identical to the test screen described above with respect to FIG. 2. In particular, the test screen can include text, graphics, colors, or the like, and can be used to determine whether the remote client 112 can detect the items included in the test screen. The remote client 112 then produces a hash of the test screen and sends the hash to server 102. The hash can be made of actual screen data, buffered screen data, or the like. Furthermore, the hash can be of whole or selected portions of the test screen, as described above with regard to FIGS. 6A-6C.

Once the remote client 112 sends the hash to the server 102, the client-generated hash can be compared to a hash of the same test screen generated by the server 102. See 306. The server 102 can either pregenerate the hash and store this hash for comparison, or can generate the hash during the initiation process. If the hashes fail to match, then the gaming session can be terminated at 308. In some embodiments, a message can be provided to the remote client 112 that specifies the type of error encountered. For instance, if the remote client 112 did not hash a particular game presentation screen correctly, a message can be displayed indicating that the remote client's video card may need replacing. If the hashes match, then the remote client can be permitted to continue game play at 310.

In an alternative embodiment, instead of sending a test screen in order to compare a client-generated hash to a server-generated hash, the remote client 102 can send a hash of a memory location associated with the remote client 112. Upon receipt of the hash, the server 102 can compare the client-generated hash to a server-generated hash of a corresponding portion of the game history stored on the server 102. In some applications, the remote client 112 can periodically send such hashes to the server according to a schedule, table, or the like. In other applications, the remote client 112 can send such hashes when prompted by the server. For instance, the server may request hashes from the remote client after every fifth game. In other examples, the server may request hashes of specified memory locations according to a schedule, table, or the like.

If the client-generated and server-generated hashes fail to match, then the gaming session can be terminated. In some embodiments, a message can be provided to the remote client 112 that specifies the type of error encountered. For instance, a message can be displayed indicating that portions of the remote client's memory are corrupt. In other embodiments, if the client-generated hash does not match the server-generated hash, then a patch can be applied to correct the defect in the remote client's system. After the patch is applied and effective, then game play can proceed. In the present embodiment, if the client-generated and server-generated hashes match, then the remote client can be permitted to continue game play.

Figure 4:
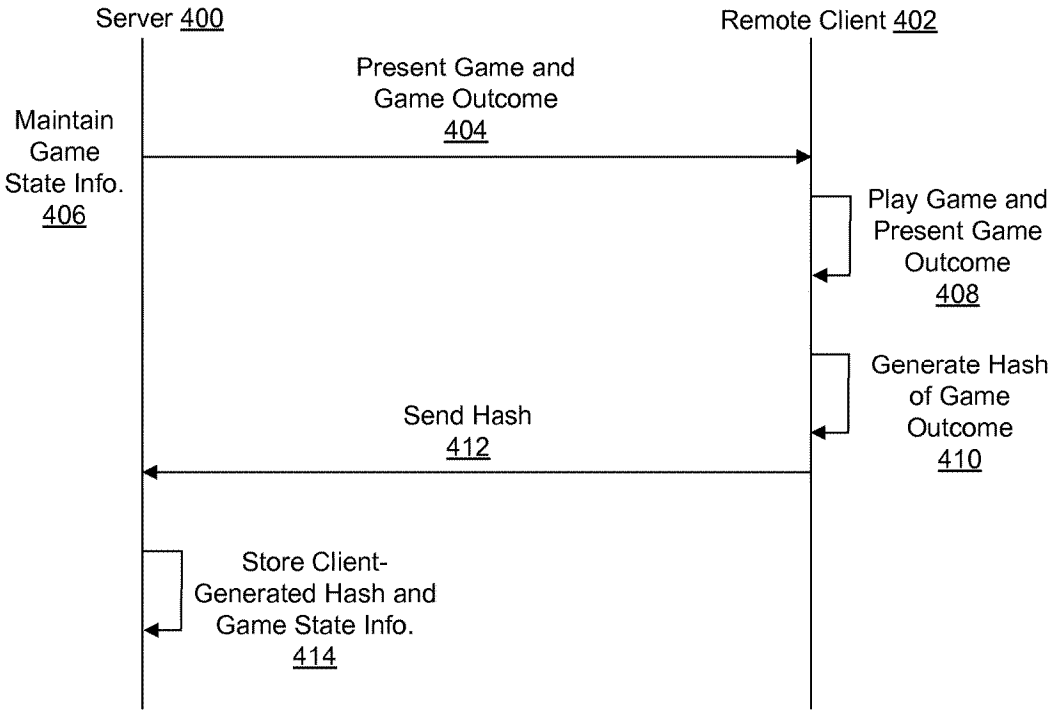
FIG. 4 is an interaction diagram depicting a process for storing game history information according to one embodiment.

With reference to FIG. 4, shown is an interaction diagram depicting a process for storing game history information according to one embodiment. Server 400 presents a game of chance to a remote client 402. During such presentation, server 400 stores game history information associated with the game of chance. See 406. As part of presenting the game of chance, the server 400 provides a game outcome. See 404. Both the game of chance and the game outcome are presented visually on the remote client 402. See 408. In some examples, the visual game outcome can be displayed in the form of a screen shot, picture, .jpg, .gif, or the like. In other examples, the visual game outcome can be a video card capture that is rendered with selected software. For a description of frame capture of actual game play, see U.S. patent application Ser. No. 09/689,498 entitled "FRAME BUFFER CAPTURE OF ACTUAL GAME PLAY," by LeMay et al., and filed on Oct. 11, 2000, now U.S. Pat. No. 6,863,608, and U.S. Pat. No. 7,384,339, entitled "FRAME BUFFER CAPTURE OF ACTUAL GAME PLAY," by LeMay et al., both applications of which are incorporated by reference in their entirety for all purposes.

Next, at 410, the remote client 402 generates a hash of the visual game outcome. As described above with regard to FIG. 2, the hash can be made of actual screen data, buffered screen data, or the like, such as a frame capture, picture, image, etc. The hash can be made in any convenient format such as an MD5 hash, or the like. The MD5 hash can produce a digest of about 16 bytes. Furthermore, the hash can be of whole or selected portions of the visual game outcome. As described above, FIGS. 6A-6C include examples of regions of a game presentation screen that can be hashed according to various embodiments of the present invention.

In some embodiments, remote client 402 can store and retrieve pregenerated hashes that are associated with predetermined outcomes, instead of generating hashes for each game outcome. For instance, each time fifty credits are awarded for obtaining a row of cherries in a video slot game, a pregenerated hash associated with this outcome can be retrieved. Once the hash is generated or retrieved, the hash can be sent to server 400. See 412. Next, the client-generated hash and game history can be stored at the server. See 414.

In an alternative embodiment, instead of sending a hash of a game outcome from the remote client 402 to the server 400, the remote client 402 can buffer the visual game outcome and send this visual game outcome to server 400 if there is sufficient bandwidth and memory to support sending and storing such large files. In some embodiments, this visual game outcome can be sent to server 400 along with a hash of the visual game outcome. Furthermore, in some applications, the visual game outcome can be stored on remote client 402. For instance, the remote client 402 can store the file in a memory, etc. The remote client 402 can also store a copy of the client-generated hash in various embodiments.

Figure 5:
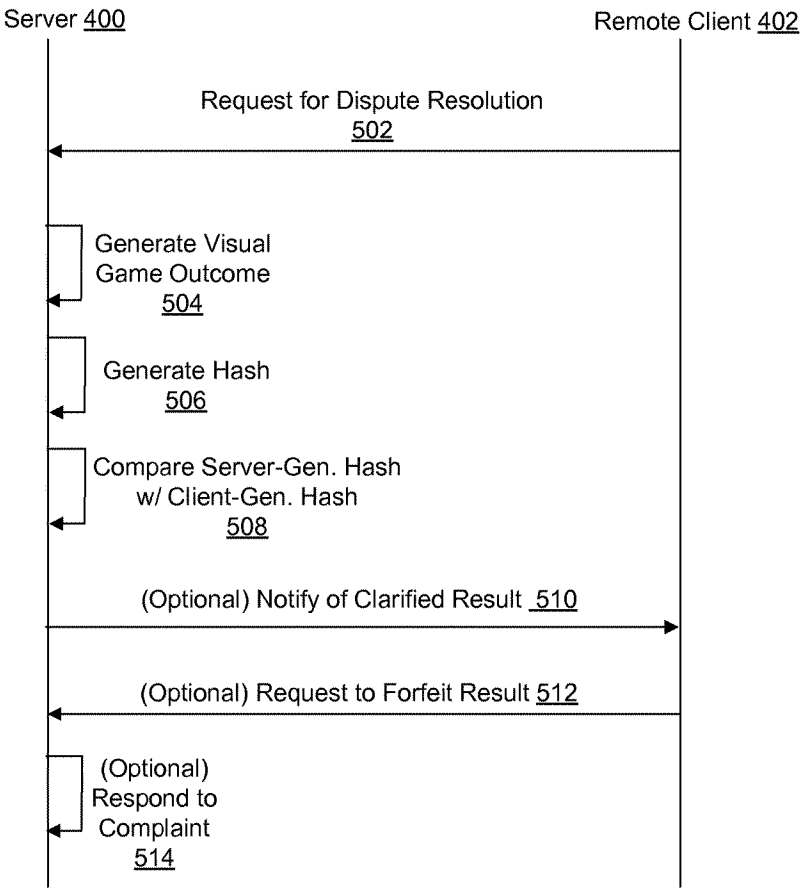
FIG. 5 is an interaction diagram depicting a process for resolving a dispute regarding a game outcome according to one embodiment.

With reference to FIG. 5, shown is an interaction diagram depicting a process for resolving a dispute regarding a game outcome according to one embodiment. At 502, remote client 402 makes a request to resolve a dispute regarding a game outcome. This request can be made from a menu displayed on the remote client. For instance, a player can select an option to request dispute resolution and specify the type of dispute. In one example, the type of dispute may relate to a game outcome, such as whether a winning configuration was provided. In another example, the type of dispute may relate to the type of award provided, such as credits, an in-kind prize, or the like.

At 504, once server 400 receives this request, then server 400 generates a visual game result using the stored game history information described above with regard to item 406 in FIG. 4. This visual game outcome can be generated at the server 400 by loading the same or similar version of the game used by the remote client 402 onto a machine having the same or similar features and capabilities as the remote client 402, as determined during the initiation process described in FIG. 2 at 204. The game history information stored by server 400 can then be used on the machine to regenerate the visual game outcome.

Once the visual game outcome is generated, then at 506, server 400 can generate a hash of the regenerated visual game outcome. This server-generated hash is then compared to the client-generated hash that was stored with the game history information on the server 400. See 508. If the client-generated hash matches the server-generated hash, then there is no dispute and the game outcome is confirmed. In this case, confirmation of this game outcome can be sent as notification to remote client 402. See 510. Furthermore, in some applications, the confirmed game outcome can be displayed at the remote client 402. This confirmed game outcome can be a picture, image, or the like, generated by the server 400. In addition, the confirmed game outcome can be stored with the game history information at server 400, in the form of a picture, image, notation, message, or the like.

If the client-generated hash does not match the server-generated hash, then there is a dispute. At 510, a notification can be sent to the remote client 402 indicating that a dispute exists. Depending on the application, various options may be presented when a dispute exists. For instance, the remote client 402 can be provided with an option to forfeit the game outcome if the server-generated hash does not match the client-generated hash. If the remote client chooses to forfeit the game outcome at 512, then the dispute can be resolved. In another example, the remote client 402 can be provided with an option to continue game play while the dispute is resolved. In yet another example, the remote client 402 can be provided with an option to discontinue game play at least until the dispute is resolved. If a dispute is found and the player at the remote client 402 wishes to pursue resolution of the dispute, then an operator associated with the gaming establishment can be notified. This notification can include a request that the operator arbitrate the dispute. The operator can then respond to the complaint and arbitrate the dispute. See 514. This arbitration may involve human intervention and evaluation of the game history information and the visual game outcomes displayed (such as at display 106 in FIG. 1). It may also include follow-up contact with the player at the remote client 402. In certain circumstances, evaluation of the remote client 402 by the operator may be appropriate as well. Additional follow-up procedures can also be included during resolution of the dispute, and any of the above options can be combined according to various applications.

In some embodiments, when a dispute arises, the server-generated visual game result can be displayed at the remote client. The player at the remote client 402 can then accept or reject this game outcome as generated by the server 400. If the player accepts the game outcome, then the dispute can be resolved. If the player does not accept the game outcome, then the dispute can be pursued as described above. In other embodiments, the server-generated visual game result can be displayed to the player so that the player is aware of the nature of the dispute, and may require no input or interaction by the player. For instance, the discrepancy in the visual game outcomes may appear only in the number of credits: the client-generated visual game outcome may show 10 credits, whereas the server-generated visual game outcome may show 100 credits.

In an alternative embodiment, instead of generating a hash at 506 and comparing a server-generated hash with a stored client-generated hash at 508, the visual game result generated at the server at 504 can be compared to a client-generated visual game outcome stored at the server. In particular, as described above with regard to FIG. 4, client-generated visual game outcomes can be stored at the server 400 with game history information if bandwidth and other system parameters permit. In such cases, the visual game outcomes can be compared in place of or in addition to comparing hashes of the visual game outcomes.

Although various embodiments of the present invention are described with a remote client located in a different physical location from where the gaming establishment or server is located, it should be recognized that the remote client can be any device that is outside the control and monitoring of the gaming establishment. As such, outcomes on gaming machines, such as a video slot machine, video poker machine, or the like, whether located at the gaming establishment or remotely, can be verified using various embodiments of the present invention, especially when such gaming machines are outside the control and monitoring of the gaming establishment.

CONCLUSION

Although the above generally describes the present invention according to specific exemplary processes and apparatus, various modifications can be made without departing from the spirit and/or scope of the present invention. Therefore, the present invention should not be construed as being limited to the specific forms shown in the appended figures and described above.

What is claimed is:

1. A method of operating a gaming system, said method comprising:

(a) receiving, from a remote client, a selection of a game of chance to be displayed on the remote client;

(b) prior to beginning game play of the selected game of chance on the remote client:

(i) generating instructions for a test image, the test image including a representative outcome available to be displayed in a subsequent game play of the selected game of chance, (ii) causing a server to send the generated instructions for the test image to the remote client to cause the remote client to display the test image on a display device associated with the remote client, (iii) causing the display device of the remote client to display one or more questions about content of the test image, (iv) receiving one or more inputs from a player, via an input device of the remote client, of one or more answers associated with the one or more displayed questions, wherein each answer is associated with one of the one or more questions, (v) determining that each received answer correlates with a correct answer to the associated question, (vi) determining if the remote client is capable of game play of the selected game of chance, said determination being based on the one or more answers, and (vii) storing information associated with the test image, the one or more questions, and the answers; and (c) if the remote client is determined to be capable of game play of the selected game of chance:

(i) receiving a wager on the selected game of chance, (ii) determining a game outcome for a play of the selected game of chance, and (iii) displaying, via the display device of the remote client, the determined game outcome of the play of the selected game of chance.

2. The method of claim 1, which includes repeatedly determining that the remote client is capable of game play of the selected game of chance prior to beginning game play of the selected game of chance on the remote client.

3. The method of claim 1, which includes:

receiving a selection of a new game of chance for play on the remote client, the new game of chance being different from the previously selected game of chance;

generating instructions for a new test image, the new test image including a representative outcome available to be displayed in a subsequent game play of the new game of chance;

sending the generated instructions for the new test image to the remote client to cause the remote client to display the new test image on the display device associated with the remote client; and generating one or more questions about content displayed in the new test image.

4. The method of claim 1, wherein the remote client is a mobile gaming device.

5. The method of claim 1, which includes:

receiving, from the remote client, a hash of the test image, cause the server to generate the test image;

hashing the generated test image; and determining if the hash of the test image received from the remote client matches the server-generated hash of the test image.

6. The method of claim 5, wherein the hashes are both taken of corresponding portions of the test image displayed by the remote client and the server-generated test image.

7. The method of claim 6, wherein the portions include an outline of one or more shapes, a color, a region, or a payline.

8. The method of claim 1, which includes performing periodic diagnostics on the remote client.

9. The method of claim 8, wherein performing periodic diagnostics on the remote client includes:

causing a server to send a first test image to the remote client;

receiving, from the remote client, a hash of the first test image displayed by the remote client; and determining if the hash of the first test image received from the remote client matches a hash of the first test image generated by the server.

10. The method of claim 1, which includes:

receiving a request from the remote client to resolve a dispute regarding the determined game outcome;

receiving a first image displayed by the remote client;

causing the server to generate a second image using stored game history information associated with the first image;

comparing the first image to the second image to determine whether information displayed in the first image matches information displayed in the second image.

11. The method of claim 1, which includes:

receiving a request from the remote client to resolve a dispute regarding the determined game outcome;

receiving a first hash of a first image displayed by the remote client;

causing the server to generate a second image using stored game history information associated with the first image;

generating a second hash of the second image;

comparing the first hash to the second hash to determine whether information displayed in the first image matches information displayed in the second image.

12. The method of claim 1, which includes:

establishing communications between the server and the remote client;

determining a type of hardware used by the remote client; and determining if the determined type of hardware is compatible with the selected game of chance.

13. The method of claim 12, wherein determining if the determined type of hardware is compatible with the selected game of chance includes determining a screen resolution of the remote client.

14. The method of claim 1, wherein the server and the remote client communicate via an internet.

15. The method of claim 1, wherein the server and the remote client communicate via a wireless communication connection.

16. The method of claim 1, which includes:

receiving a file of the test image displayed by the display device of the remote client; and causing the server to store the received file.

17. The method of claim 1, wherein a credit balance is decreasable based on the received wager, and said credit balance associated is: (i) increasable via an acceptor of a physical item associated with a monetary value, and (ii) decreasable via a cashout device configured to receive an input to cause an initiation of a payout associated with the credit balance.

18. A gaming system comprising:

a network; and a server configured to:

(a) receive, from a remote client, a selection of a game of chance to be displayed on the remote client, wherein the remote client is configured to communicate with the server via the network;

(b) prior to beginning game play of the selected game of chance on the remote client:

(i) generating instructions for a test image, the test image including a representative outcome available to be displayed in a subsequent play of the selected game of chance, (ii) sending the generated instructions for the test image to the remote client to cause the remote client to display the test image on a display device associated with the remote client, (iii) causing the display device of the remote client to display one or more questions about content of the test image, (iv) receiving data associated with one or more answers, inputted from a player via an input device of the remote client, to the one or more displayed questions, wherein each answer is associated with one of the one or more questions, (v) determining that each received answer correlates with a correct answer to the associated question, (vi) determining if the remote client is capable of game play of the selected game of chance, said determination being based on the one or more answers, and (vii) storing information associated with the test image, the one or more questions, and the answers; and (c) if the remote client is determined to be capable of game play of the selected game of chance:

(i) receiving a wager on the selected game of chance, and (ii) determining a game outcome for a play of the selected game of chance, (iii) causing the display device of the remote client to display the determined game outcome of the play of the selected game of chance;

the remote client configured to communicate with the server and including the display and the input device; and a network configured to allow communication between the server and the remote client.

19. The gaming system of claim 18, wherein the remote client is a mobile gaming device.

20. The gaming system of claim 18, wherein the network includes one or more wireless links.

21. The gaming system of claim 18, wherein a credit balance is decreasable based on the received wager, and said credit balance associated is: (i) increasable via: an acceptor of a physical item associated with a monetary value, and (ii) decreasable via a cashout device configured to receive an input to cause an initiation of a payout associated with the credit balance.

* * * * *